US012747564B2

(12) United States Patent
Miller et al.

(10) Patent No.: US 12,747,564 B2
(45) Date of Patent: Sep. 29, 2026

(54) PLATE COMPACTOR

(71) Applicant: MILWAUKEE ELECTRIC TOOL CORPORATION, Brookfield, WI (US)

(72) Inventors: Joseph W. Miller, Waukesha, WI (US); Ian C. Richards, Milwaukee, WI (US); Evan M. Glanzer, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 166 days.

(21) Appl. No.: 18/407,538

(22) Filed: Jan. 9, 2024

(65) Prior Publication Data

US 2024/0229426 A1 Jul. 11, 2024

Related U.S. Application Data

(60) Provisional application No. 63/479,113, filed on Jan. 9, 2023.

(51) Int. Cl.

| | |
|---|---|
| ***E02F 9/26*** | (2006.01) |
| ***E02D 3/068*** | (2006.01) |
| ***E02F 3/58*** | (2006.01) |
| ***E02F 9/08*** | (2006.01) |
| ***E02F 9/20*** | (2006.01) |

(52) U.S. Cl.

CPC ..... *E02F 9/264* (2013.01); *E02D 3/068* (2013.01); *E02F 3/58* (2013.01); *E02F 9/0858* (2013.01); *E02F 9/2025* (2013.01)

(58) Field of Classification Search

CPC . E02F 9/264; E02F 3/58; E02F 9/0858; E02F 9/2025; E02D 3/068

See application file for complete search history.

(56) References Cited

U.S. PATENT DOCUMENTS

| | | | |
|---|---|---|---|
| 3,732,022 A | 5/1973 | Danuser | |
| 4,595,384 A | 6/1986 | Tertinek | |
| 4,947,940 A | 8/1990 | Dickey et al. | |
| 9,915,040 B2 * | 3/2018 | Bletscher | E01C 19/004 |

(Continued)

FOREIGN PATENT DOCUMENTS

| | | |
|---|---|---|
| CN | 2633941 Y | 8/2004 |
| CN | 204139155 U | 2/2015 |

(Continued)

OTHER PUBLICATIONS

Translation of Cn 109115487 (Year: 2019).*

*Primary Examiner* — Hitesh Patel
*Assistant Examiner* — Joshua Jeffrey Penko
(74) *Attorney, Agent, or Firm* — Michael Best & Friedrich LLP

(57) ABSTRACT

A compactor includes a plate, a frame coupled to the plate, and an exciter assembly coupled to the plate and including an exciter shaft, an exciter pulley on the exciter shaft, and an eccentric weight on the exciter shaft. The compactor also includes a motor coupled to the frame and having an output shaft and a drive pulley on the output shaft, a belt wrapped around the exciter pulley and the drive pulley at a minimum tension value for transferring torque from the drive pulley to the exciter pulley, causing it to rotate, and a sensing circuit configured to detect if the tension in the belt is below the minimum tension value.

20 Claims, 7 Drawing Sheets

(56) References Cited

U.S. PATENT DOCUMENTS

| | | | | |
|---|---|---|---|---|
| 10,344,439 | B2 * | 7/2019 | Steffen | E01C 19/38 |
| 11,235,934 | B2 * | 2/2022 | Kataria | B65G 43/04 |
| 2022/0162813 | A1 | 5/2022 | Glanzer | |

FOREIGN PATENT DOCUMENTS

| | | | | | |
|---|---|---|---|---|---|
| CN | 205975572 | U | | 2/2017 | |
| CN | 206529761 | U | | 9/2017 | |
| CN | 206887929 | U | | 1/2018 | |
| CN | 208251064 | U | | 12/2018 | |
| CN | 109115487 | A | * | 1/2019 | G01M 13/023 |
| DE | 102008011208 | B3 | | 9/2009 | |
| JP | H09329207 | A | | 12/1997 | |
| JP | H10132041 | A | | 5/1998 | |
| JP | H11323820 | A | | 11/1999 | |
| JP | 2000097299 | A | | 4/2000 | |
| WO | 2006001230 | A1 | | 1/2006 | |
| WO | 2011157344 | A1 | | 12/2011 | |

* cited by examiner

PLATE COMPACTOR

CROSS-REFERENCE TO RELATED APPLICATIONS

This application claims priority to U.S. Provisional Patent Application No. 63/479,113 filed on Jan. 9, 2023, the entire contents of which are incorporated herein by reference.

FIELD OF THE INVENTION

The present invention relates to outdoor power equipment, and more specifically to belt-driven outdoor power equipment.

BACKGROUND OF THE INVENTION

Belt-driven outdoor power equipment includes a drive assembly, a working assembly, and a belt operatively coupled to the drive assembly and to the working assembly to transmit power from the drive assembly to the working assembly. For example, a plate compactor includes a plate (i.e., working assembly) and an engine (i.e., drive assembly). The plate is coupled to the motor by a belt to cause the plate to be driven to vibrate in order to compact soil or other loose material.

SUMMARY OF THE INVENTION

The present disclosure provides, in one aspect, a compactor including a plate, a frame coupled to the plate, an exciter assembly coupled to the plate and including an exciter shaft, an exciter pulley on the exciter shaft, and an eccentric weight on the exciter shaft, a motor coupled to the frame and having an output shaft and a drive pulley on the output shaft, a belt wrapped around the exciter pulley and the drive pulley at a minimum tension value for transferring torque from the drive pulley to the exciter pulley, causing it to rotate, and a sensing circuit configured to detect if the tension in the belt is below the minimum tension value.

In some aspects, an indicator is configured to alert an operator if the tension in the belt is below the minimum tension value.

In some aspects, the sensing circuit includes a motor sensor configured to detect a rotational speed of the motor output shaft, an exciter sensor configured to detect a rotational speed of the exciter shaft, and an electronic control unit configured to receive output from the motor sensor and the exciter sensor and configured to determine, based on the output, if the tension in the belt is less than the minimum tension value.

In some aspects, the sensing circuit includes a motor sensor configured to detect a rotational speed of the motor output shaft, a current sensor configured to detect an electrical current drawn by the motor, and an electronic control unit configured to receive output from the motor sensor and the current sensor and configured to determine, based on the output, if the tension in the belt is less than the minimum tension value.

In some aspects, the sensing circuit is configured to directly measure a characteristic of the belt to detect if the belt tension is below the minimum tension value.

In some aspects, the sensing circuit is configured to measure vibration of the belt.

In some aspects, the sensing circuit includes a non-contact sensor configured to measure vibration of the belt.

The present disclosure provides, in another aspect, an outdoor power equipment including a drive assembly, a working assembly, a belt operatively coupled to the drive assembly and to the working assembly, the belt configured to transfer torque from the drive assembly to the working assembly, and a sensing circuit configured to detect if an amount of tension in the belt is below a minimum tension value. The sensing circuit indirectly determines the amount of tension in the belt.

In some aspects, the sensing circuit includes a load cell configured to detect a load applied by the belt onto the drive assembly.

In some aspects, the sensing circuit includes a load cell configured to detect a load applied by the belt onto the working assembly.

In some aspects, the load cell is a first load cell, and wherein the sensing circuit further includes a second load cell configured to detect a load applied by the belt onto the drive assembly.

In some aspects, the sensing circuit includes an electronic control unit configured to receive output from the first and second load cells and, from the output, determines the amount of tension in the belt.

In some aspects, an indicator is configured to alert an operator of the outdoor power equipment if the tension within the belt is below the minimum tension value.

The present disclosure provides, in yet another aspect, an outdoor power equipment including a drive assembly, a working assembly, a belt operatively coupled to the drive assembly and to the working assembly, the belt configured to transfer torque from the drive assembly to the working assembly, and a sensing circuit configured to detect an amount of tension in the belt and to provide an indication to an operator of the outdoor power equipment if the amount of tension in the belt is below a minimum tension value.

In some aspects, the sensing circuit includes a non-contact sensor configured to detect a characteristic of the belt that correlates to the amount of tension within the belt.

In some aspects, the sensor is a laser sensor.

In some aspects, the sensor is an ultrasonic sensor.

In some aspects, the non-contact sensor is configured to detect vibration of the belt.

In some aspects, the sensing circuit includes an electronic control unit operatively coupled to the non-contact sensor, and wherein the electronic control unit is configured to correlate the vibration of the belt with the amount of tension within the belt.

In some aspects, the outdoor power equipment is a plate compactor.

The present disclosure provides, in yet another aspect, a method for detecting tension in a belt of a plate compactor. The method includes measuring a rotational speed of a motor, measuring a rotational speed of an exciter assembly that receives torque from the motor via the belt, and calculating, based on relative rotational speeds of the motor and of the exciter assembly, if the tension in the belt is less than a minimum tension value.

In some aspects, the method further includes providing, with an indicator, an alert to an operator if the tension in the belt is less than the minimum tension value.

In some aspects the alert is provided as an audio alert, a visual alert, or a combination of an audio alert and a visual alert.

The present disclosure provides, in yet another aspect, a method for detecting tension in a belt of a plate compactor. The method includes measuring a rotational speed of a motor, measuring an electrical current drawn by the motor while rotating an exciter assembly with the belt, and calculating, using the measured rotational speed and electrical current, if the tension in the belt is less than a minimum tension value.

In some aspects, the method further includes providing, with an indicator, an alert to an operator if the tension in the belt is less than the minimum tension value.

In some aspects, the alert is provided as an audio alert, a visual alert, or a combination of an audio alert and a visual alert.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
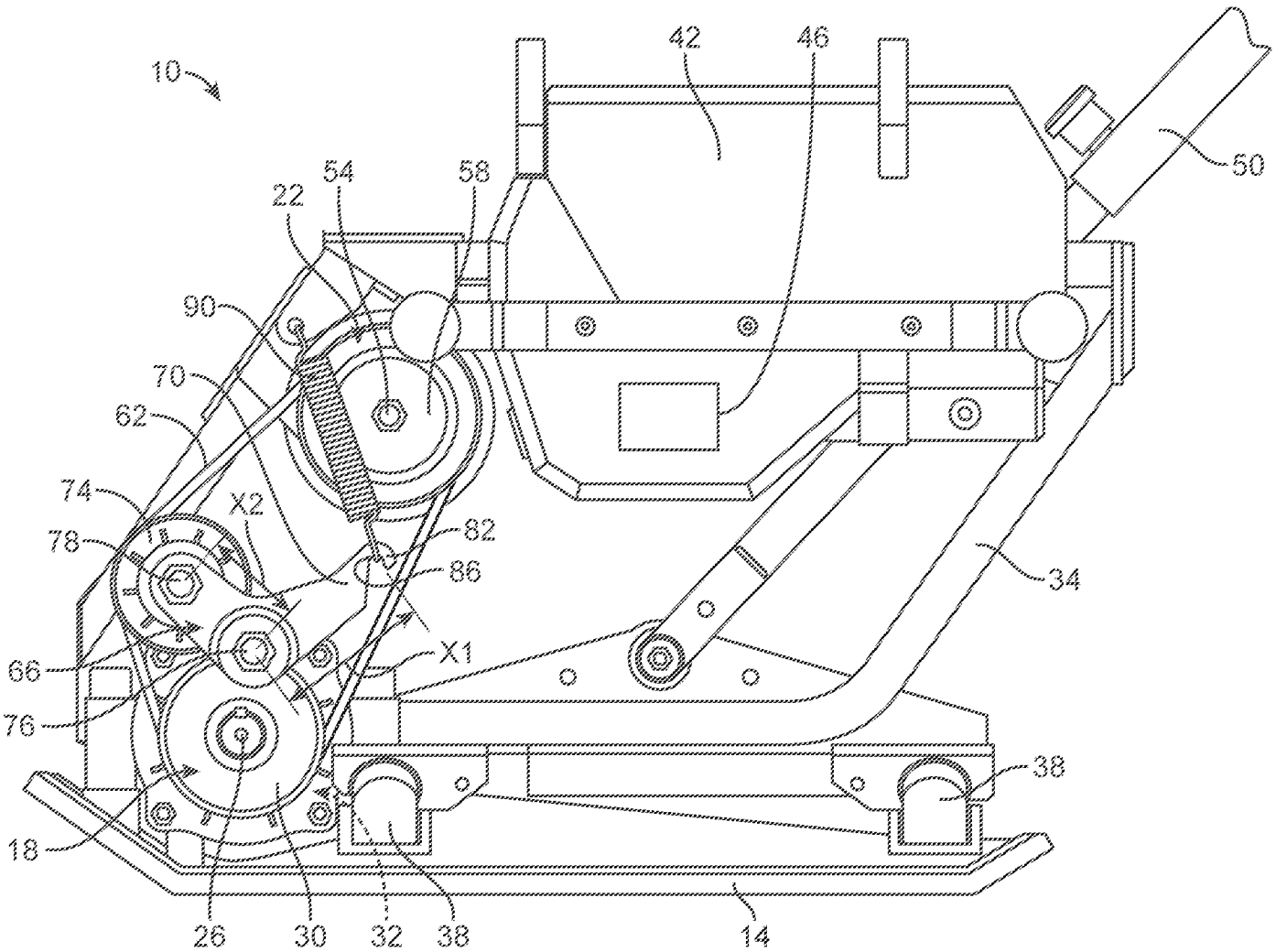
FIG. 1 is a plan view of a plate compactor according to one embodiment of the present disclosure.

As shown in FIG. 1, a plate compactor 10 includes a base plate 14, a working assembly illustrated as an exciter assembly 18 mounted to the plate 14, and a drive assembly illustrated as an electric motor 22 to drive the exciter assembly 18, thus causing the plate 14 to vibrate. The exciter assembly 18 includes an exciter shaft 26 on which an exciter pulley 30 and an eccentric weight 32 are coupled for rotation. The plate compactor 10 also includes a frame 34 vibrationally isolated from the plate 14 via vibration dampers, such as springs or isolators 38. A battery pack 42 is also mounted to the frame 34 and is configured to provide power to the electric motor 22. A set of control electronics 46 (shown schematically) are configured to control operation of the electric motor 22. A handle 50 extends from the frame 34 and allows the plate compactor 10 to be pushed or maneuvered.

The motor 22 includes an output shaft 54 that is parallel with the exciter shaft 26. A drive pulley 58 is coupled for co-rotation with the output shaft 54 and is configured to drive rotation of the exciter pulley 30 via a belt 62 that is wrapped around both the exciter pulley 30 and drive pulley 58. The plate compactor 10 also includes a tensioner assembly 66 for the belt 62. The tensioner assembly 66 includes an idler arm 70 pivotably mounted to the frame 34, an idler pulley 74 rotatably mounted to a first end 78 of the idler arm 70, a hook 82 formed on an opposite, second end 86 of the idler arm 70, and a tension spring 90 interconnecting the frame 34 and the hook 82. The idler arm 70 is sized such that a distance X1 from a pivot point 76 to the second end 86 is greater than a distance X2 from the pivot point 76 to the first end 78. Thus, from the frame of reference of FIG. 1, the spring 90 biases the idler arm 70 in a counter-clockwise rotational direction to move the idler pulley 74 toward the belt 62 and maintain tension in the belt 62.

In operation, the belt 62 may be replaced on the plate compactor 10 by first pivoting the idler arm 70, from the frame of reference of FIG. 1, in a clockwise direction to disengage the idler pulley 74 from the belt 62. A new belt 62 is then wrapped around the exciter pulley 30, the drive pulley 58, and the idler pulley 74. The idler arm 70 may then be released, allowing the tension spring 90 to rebound and pivot the idler pulley 74 back toward the belt 62, thus creating tension in the belt 62.

The plate compactor 10 may then be operated. Specifically, the control electronics 46 activates the motor 22, thus rotating the output shaft 54 and drive pulley 58. Rotation of the drive pulley 58 results in rotation of the idler pulley 74 and exciter pulley 30, thus causing rotation of the exciter shaft 26. Rotation of the exciter shaft 26 causes rotation of the eccentric weight 32 about the exciter shaft 26, thus transmitting vibration from the exciter assembly 18 to the plate 14, which thereby compacts the ground underneath.

As the plate compactor 10 is operated over its lifetime, the belt 62 may stretch and thus extend in length, which can otherwise lead to reduced tension in the belt 62. However, the tensioner assembly 66 ensures that the belt 62 is maintained at a relatively constant tension throughout the life of the belt 62 because the spring 90 ensures that the idler pulley 74 is biased against the belt 62 regardless of how much the belt 62 has stretched, which increases the useful life of the belt 62. Also, the tensioner assembly 66 simplifies installation and removal of the belt 62 on the exciter and drive pulleys 30, 58, compared to a plate compactor without the tensioner assembly 66.

Figure 2:
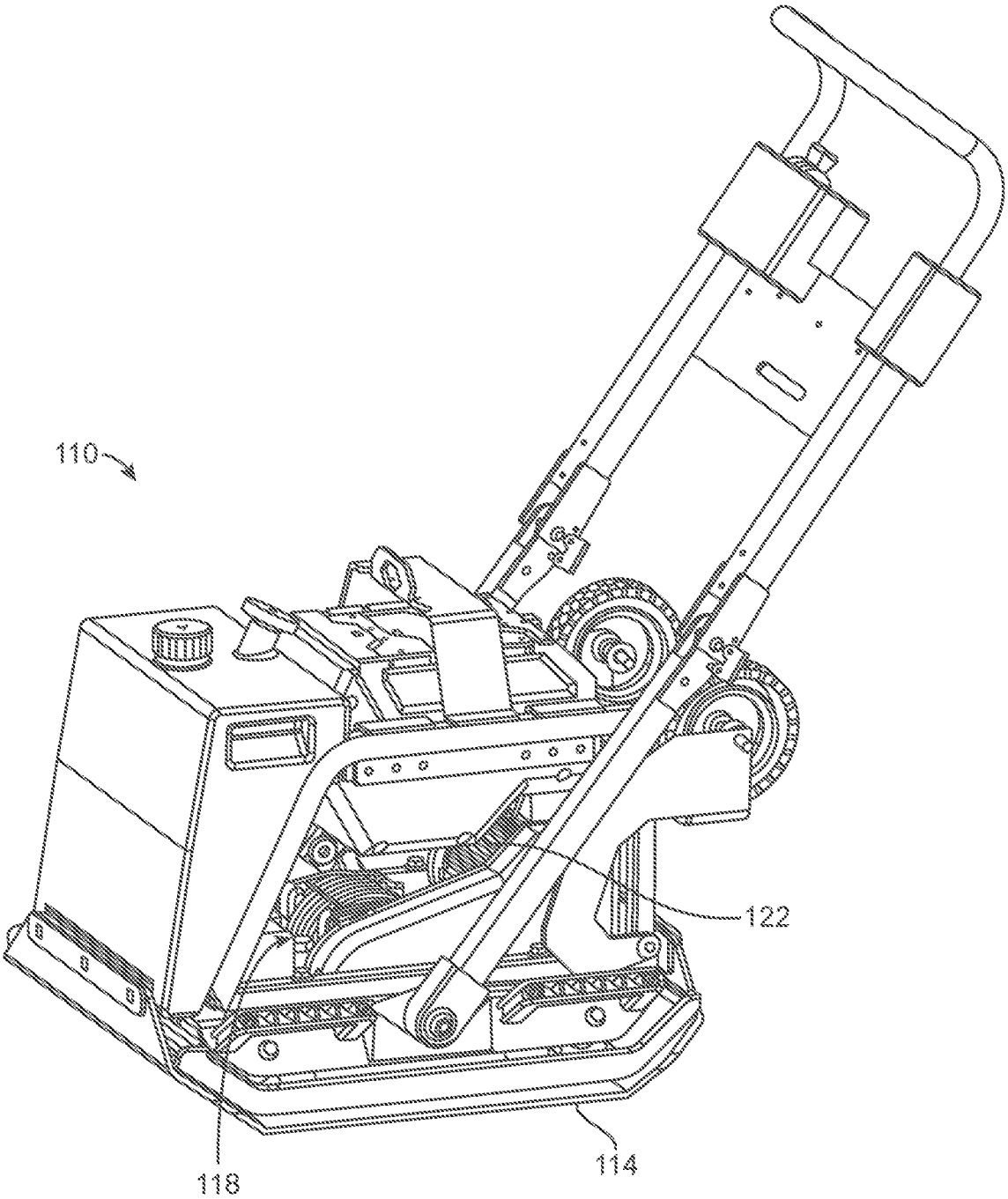
FIG. 2 is a perspective view of a plate compactor according to another embodiment of the present disclosure.
Figure 3:
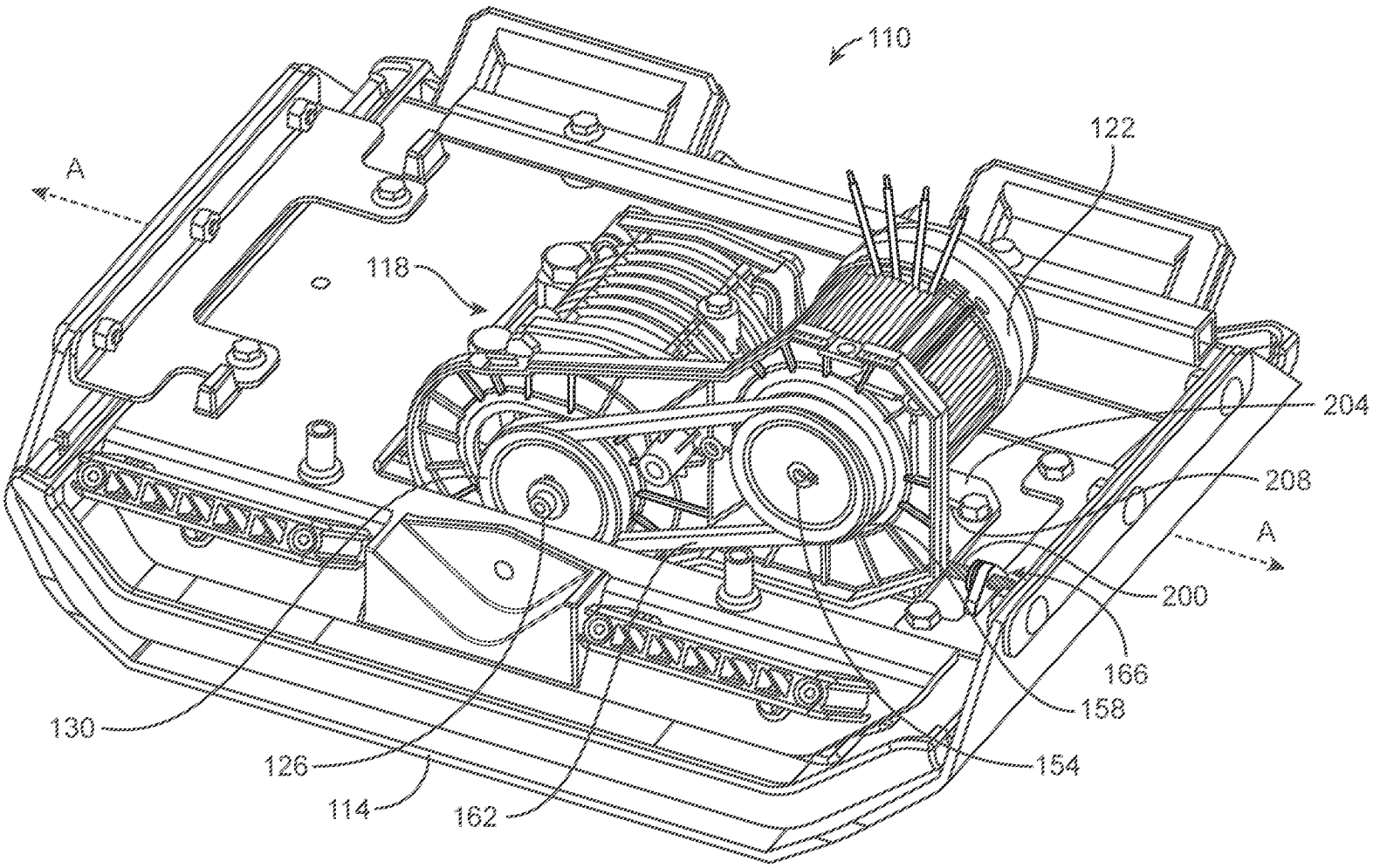
FIG. 3 is a perspective view of a portion of the plate compactor of FIG. 2, with components hidden to show a front side of a vibration mechanism.
Figure 4:
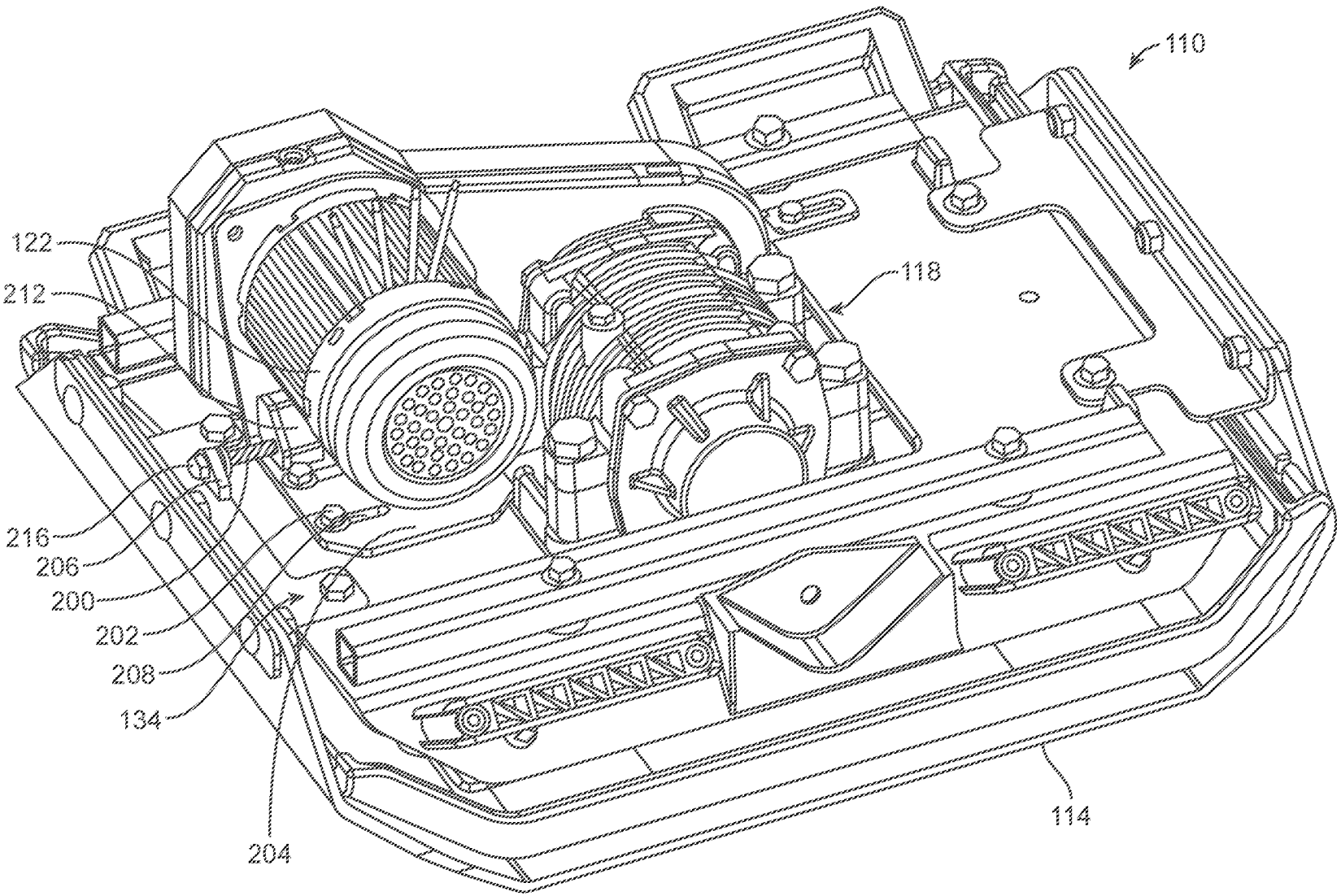
FIG. 4 is a perspective view of a portion of the plate compactor of FIG. 2, with components hidden to show a rear side of the vibration mechanism.

FIGS. 2-4 depict another embodiment of a plate compactor 110 including a tensioner assembly 166, with like features having like reference numerals plus the number "1" appended thereon. With reference to FIG. 2, the plate compactor 110 includes a base plate 114, an exciter assembly 118 mounted to the plate 114, and an electric motor 122 configured to drive the exciter assembly 118, thus causing the plate 114 to vibrate. The motor 122 is disposed on the plate 114 adjacent the exciter assembly 118 and oriented such that a motor output shaft 154 is parallel with an exciter shaft 126 of the exciter assembly 118 (FIG. 3). A drive pulley 158 is coupled for co-rotation with the motor output shaft 154 and configured to drive rotation of the exciter assembly 118 through a belt 162 that is wrapped around both the drive pulley 158 and an exciter pulley 130. The exciter pulley 130 is coupled for co-rotation with the exciter shaft 126.

Proper operation of the plate compactor 110 requires the belt 162 to maintain a minimum amount of tension. To maintain minimum belt tension, the plate compactor 110 is provided with a tensioner assembly 166 so that an operator can increase or decrease the tension in the belt 162. For example, as the belt 162 wears over time, an operator can increase the tension to maintain proper tension in the belt 162. Also, an operator may decrease the tension to remove and replace the belt 162.

The tensioner assembly 166 operates by increasing or decreasing a distance between the drive pulley 158 and the exciter pulley 130. With reference to FIGS. 3 and 4, the tensioner assembly 166 includes a threaded shaft 200 coupled to the compactor 110 and to the motor 122. The motor 122 is slidably supported upon the compactor 110 by a motor bracket 204, which includes slots 208 oriented parallel to a longitudinal axis A of the plate 114. A fastener 202 extends through each of the slots 208 to clamp the motor bracket 204 to the frame 134. The compactor 110 further includes a tab 206 on the frame 134 by which the threaded shaft 200 is threadedly coupled to the compactor 110. Similarly, the motor bracket 204 is threadedly coupled to the threaded shaft 200 via an internally threaded block 212. In other words, the threaded shaft 200 extends through the tab 206 and the block 212 to threadedly couple the frame 134 and the motor bracket 204. When the fastener 202 is loosened, thereby decreasing a clamping force on the motor bracket 204, rotation of the threaded shaft 200 causes sliding of the motor bracket 204 relative to the frame 134. The slots 208 constrain the sliding motion of the motor bracket 204 to a direction parallel to the longitudinal axis A of the plate 114. Therefore, rotation of the threaded shaft 200 increases or decreases the distance between the drive pulley 158 and the exciter pulley 130, depending on a direction of rotation of the threaded shaft 200. In the illustrated embodiment, the threaded shaft 200 includes a bolt head 216 affixed to a distal end of the shaft 200 on an opposite end of the shaft 200 from the motor bracket 204. Further, in some embodiments, the tensioner assembly 166 includes a thrust bearing or washer disposed between the bolt head 216 and the tab 206 to reduce friction between the bolt head 216 and the tab 206 during rotation of the threaded shaft 200 (e.g., during tensioning of the belt 162).

Figure 5:
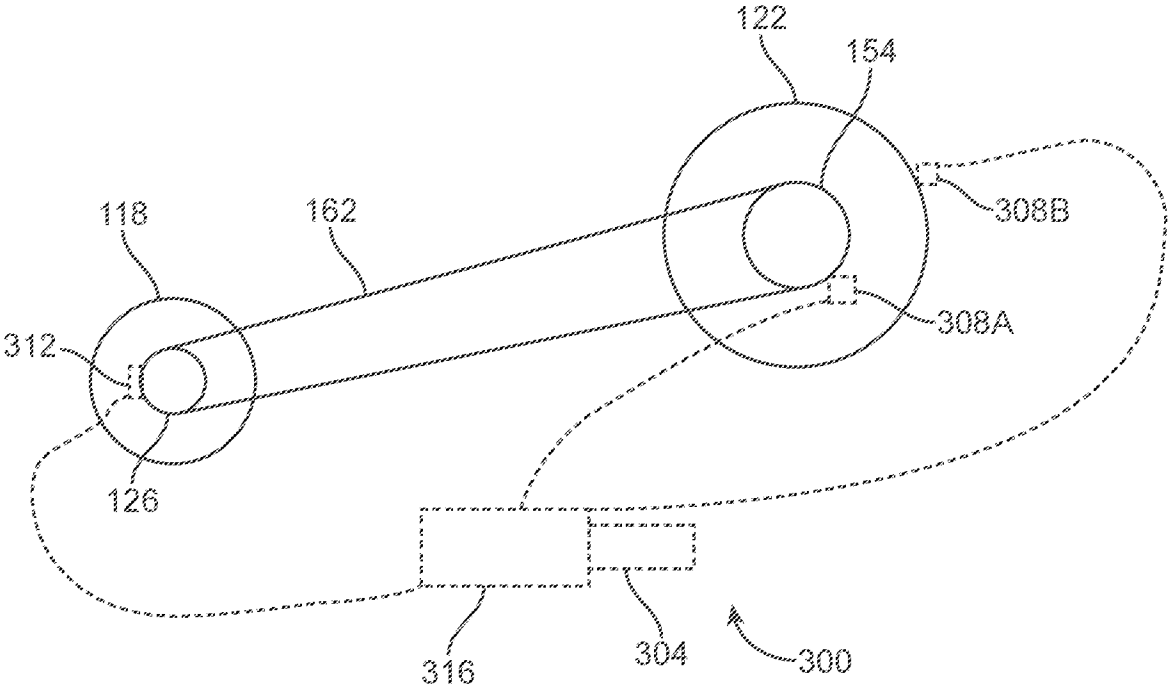
FIG. 5 is a schematic view of a sensing circuit for detecting tension of a belt for use in either of the plate compactors of FIG. 1 or 2.

With reference to FIG. 5, the plate compactor 110 further includes a belt sensing circuit 300 to detect if the belt 162 is out of tension (e.g., below a minimum amount of tension, or a minimum tension value, required for proper transmission of torque from the motor 122 to the exciter assembly 118) and an indicator 304 to notify the operator when the belt 162 is out of tension. When the belt 162 is out of tension, the plate compactor 110 may perform poorly or cease functioning all together, because torque from the motor 122 is not transferred properly to the exciter assembly 118. The belt sensing circuit 300 and indicator 304 respectively determine and notify the operator if belt tension is the source of poor plate compactor performance, thereby reducing downtime for maintenance.

The belt sensing circuit 300 includes a motor sensor 308, an exciter sensor 312, and an electronic control unit 316, which may be integrated into the control electronics 146 of the plate compactor 110. The motor sensor 308 is operably coupled to the motor 122 to determine characteristics of the motor 122, such as a rotational speed of the motor output shaft 154 or the amount of electrical current drawn by the motor 122. The motor sensor 308 may be any type of sensor capable of detecting the motor characteristics. For example, in some embodiments, the motor sensor 308 may include a Hall-effect sensor 308A for determining the rotational speed of the motor output shaft 154. In some embodiments, a sense resistor 308B may alternatively, or additionally, be included in the circuit 300 to determine the amount of electrical current drawn by the motor 122.

The exciter sensor 312 is operably coupled to the exciter assembly 118 to measure a rotational speed of the exciter shaft 126. The exciter sensor 312 may include any type of sensor capable of detecting a rotational speed of the exciter shaft 126. For example, the exciter sensor 312 may include a Hall-effect sensor proximate the exciter shaft 126.

The electronic control unit 316 utilizes data output by the motor sensor 308 and the exciter sensor 312 to determine if the belt 162 is slipping or broken. In one embodiment, the electronic control unit 316 compares the rotational speed of the motor output shaft 154 to the rotational speed of the exciter shaft 126. If the rotational speed of the motor output shaft 154 relative to the exciter shaft 126 is higher than a predetermined value, the electronic control unit 316 will notify the operator via the indicator 304 that the belt 162 is out of tension (causing the belt 162 to slip). In some embodiments, the electronic control unit 316 may include multiple pre-determined values of the rotational speed of the motor output shaft 154 to the exciter shaft 126 that define ranges corresponding to proper belt tension, improper belt tension (e.g., belt slip), and a broken belt. If the rotational speed of the motor output shaft 154 to the exciter shaft 126 is below a first pre-determined value, the belt 162 is properly tensioned. If the rotational speed of the motor output shaft 154 to the exciter shaft 126 is between the first pre-determined value and a second pre-determined value, the belt 162 is out of tension (causing the belt to slip 162), and the electronic control unit 316 will notify the operator via the indicator 304. If the rotational speed of the motor output shaft 154 to the exciter shaft 126 is above the second pre-determined value, the belt 162 is broken, and the electronic control unit 316 will notify the operator via the indicator 304.

In some embodiments, the electronic control unit 316 may determine that the belt 162 has broken if the motor sensor 308 detects a low current drawn by the motor 122 while the motor 122 is operating at full speed, and the electronic control unit 316 may determine that the belt 162 is slipping if the motor sensor 308 detects a relatively large change in the rotational speed of the motor output shaft 154 (e.g., increase in speed) while operating under load. Furthermore, in some embodiments, the electronic control unit 316 may implement a machine learning model to detect loose or broken belt events.

The indicator 304 may provide an audio alert, a visual alert, or a combination of audio and visual alerts directed toward the operator. An audio alert may create different warning sounds based on the whether or not the electronic control unit 316 detects that the belt 162 is slipping or broken. A visual alert may include one or more lights (e.g., LEDs) to indicate whether or not the electronic control unit 316 detects that the belt 162 is slipping or broken. For example, the visual alert may include a single light that illuminates different colors for a broken belt, a slipping belt, and a properly tensioned belt. Or, the visual alert may include a plurality of lights with each light illuminating to indicate one situation (e.g., one light that illuminates to signal a broken belt and one light that illuminates to signal a slipping belt). A belt slipping alert informs the operator to increase tension in the belt 162, while a broken belt alert informs the operator to replace the belt 162.

Figure 6:
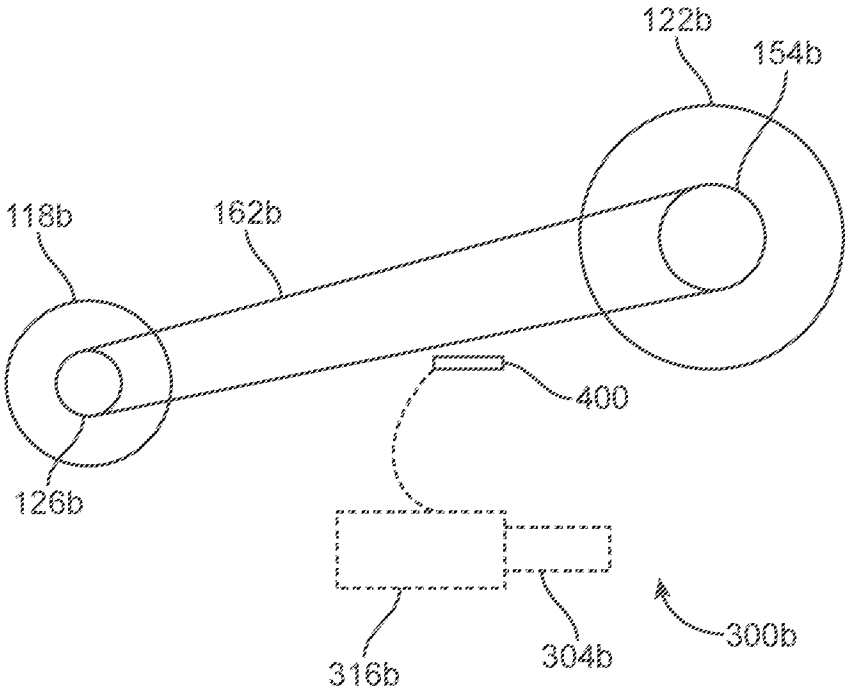
FIG. 6 is a schematic view of a sensing circuit for detecting tension of a belt for use in either of the plate compactors of FIG. 1 or 2 according to another embodiment of the present disclosure.

FIG. 6 illustrates another embodiment of a belt sensing circuit 300*b*, with like parts having like reference numerals plus the letter "b" and the following differences explained below. Unlike the belt sensing circuit 300, the belt sensing circuit 300*b* does not determine if the belt 162*b* is out of tension based on rotational speeds or current draws of the motor 122*b*. Rather, the belt sensing circuit 300*b* directly measures a characteristic of the belt 162*b* to determine if the belt 162*b* is properly tensioned. The belt sensing circuit 300*b* includes a non-contact sensor 400 operatively coupled to the electronic control unit 316*b*. In some embodiments, the non-contact sensor 400 detects vibration (amplitude and/or frequency of oscillation of the belt run between the shafts 126*b*, 154*b*) of the belt 162*b* and the electronic control unit 316*b* determines if the belt 162*b* is properly tensioned based on the detected vibration. The non-contact sensor 400 may be any suitable type of sensor for detecting vibration. For example, in some embodiments, the non-contact sensor 400 may be configured as a laser sensor to determine the vibration of the belt 162*b*. In other embodiments, the non-contact sensor 400 may be configured as an ultrasonic sensor to determine the vibration of the belt 162*b*.

In some embodiments, the belt sensing circuit 300*b* also includes a look-up table stored in the electronic control unit 316*b* to correlate the detected characteristic (e.g., vibration) by the non-contact sensor 400 with the amount of tension in the belt 162*b*. If the detected characteristic correlates to a value in the look-up table below a minimum belt tension value, the electronic control unit 316*b* will notify the operator via the indicator 304*b* that the belt 162*b* is out of tension (e.g., causing the belt 162*b* to slip). The indicator 304*b* may provide an audio alert, a visual alert, or a combination of audio and visual alerts directed toward the operator. In some embodiments, the electronic control unit 316*b* may include in the look-up table multiple pre-determined values of the detected characteristic that correspond to proper belt tension and improper belt tension.

Figure 7:
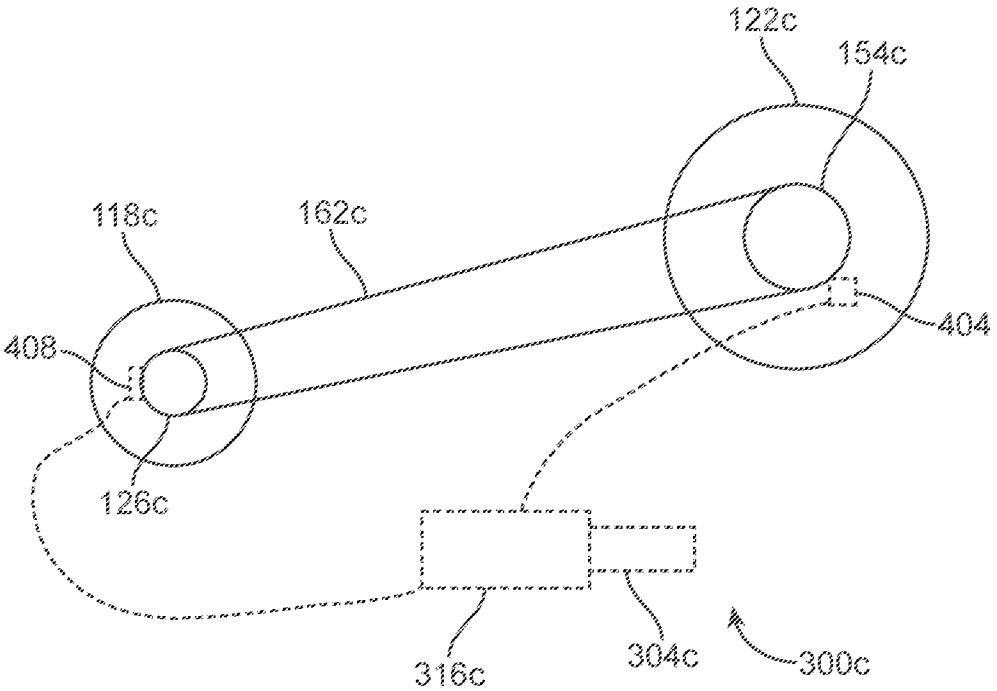
FIG. 7 is a schematic view of a sensing circuit for detecting tension of a belt for use in either of the plate compactors of FIG. 1 or 2 according to yet another embodiment of the present disclosure.

FIG. 7 illustrates yet another embodiment of a belt sensing circuit 300*c*, with like parts having like reference numerals plus the letter "c" and the following differences explained below. Similar to the belt sensing circuit 300, the belt sensing circuit 300*c* determines if the belt 162*c* is properly tensioned without directly measuring a characteristic of the belt 162*c*. Thus, the belt sensing circuit 300*c* indirectly determines is the belt 162*c* is properly tensioned. The belt sensing circuit 300*c* utilizes at least one load cell to measure a reaction force that correlates to an amount of tension in the belt 162*c*. In the illustrated embodiment, the belt sensing circuit 300*c* includes at least one of a motor load cell 404 and an exciter assembly load cell 408. The motor load cell 404 is coupled to the motor 122*c*. The motor load cell 404 detects a load or force acting on the motor 122*c* (and more specifically, the motor shaft 154*c*) and is operatively coupled to the electronic control unit 316*c*. The load acting on the motor 122*c* is indicative of an amount of tension in the belt 162*c*. The exciter assembly load cell 408 is coupled to the exciter assembly 118*c* and detects a load or force acting on the exciter assembly 118*c* (and more specifically, the shaft 126*c*). The exciter assembly load cell 408 is operatively coupled to the electronic control unit 316*c* such that the load detected by the exciter assembly load cell 408 may be used to determine an amount of tension in the belt 162*c*. The belt sensing circuit 300*c* may include one or both of the motor load cell 404 and the exciter assembly load cell 408 to indirectly measure loads that correlate to an amount of tension within the belt 162*c*. In an embodiment in which both the motor load cell 404 and the exciter assembly load cell 408 are implemented, the electronic control unit 316*c* receives an output from each of the motor load cell 404 and the exciter assembly load cell 408 and, from the outputs, determines the amount of tension in the belt In some embodiments, the belt sensing circuit 300*c* also includes a look-up table stored in the electronic control unit 316*c* to correlate the measured forces by the load cells 404, 408 with the amount of tension in the belt 162*c*. If one or more of the measured forces correlates to a value in the look-up table below a minimum belt tension value, the electronic control unit 316*c* will notify the operator via the indicator 304*c* that the belt 162*c* is out of tension (e.g., causing the belt 162*c* to slip). The indicator 304*c* may provide an audio alert, a visual alert, or a combination of audio and visual alerts directed toward the operator. In some embodiments, the electronic control unit 316*c* may include in the look-up table multiple pre-determined values of the detected characteristic that correspond to proper belt tension and improper belt tension.

While the belt sensing circuits of the present disclosure have been described in relation to a plate compactor, it should be understood that such belt sensing circuits may be implemented on other belt-driven outdoor power equipment. For example, a belt sensing circuit for determining an amount of tension within a drive belt may be implemented on a cut off saw or a green concrete saw or a power trowel, among other belt-driven outdoor power equipment.

Although the invention has been described in detail with reference to certain preferred embodiments, variations and modifications exist within the scope and spirit of one or more independent aspects of the invention as described.

Various features of the invention are set forth in the following claims.

What is claimed is:

1. A compactor comprising:

a plate;

a frame coupled to the plate;

an exciter assembly coupled to the plate and including an exciter shaft, an exciter pulley on the exciter shaft, and an eccentric weight on the exciter shaft;

a motor coupled to the frame and having an output shaft and a drive pulley on the output shaft, the motor output shaft being separate and distinct from the exciter shaft;

a belt wrapped around the exciter pulley and the drive pulley at a minimum tension value for transferring torque from the drive pulley to the exciter pulley, causing it to rotate; and a sensing circuit configured to detect if the tension in the belt is below the minimum tension value.

2. The compactor of claim 1, further comprising an indicator configured to alert an operator if the tension in the belt is below the minimum tension value.

3. The compactor of claim 2, wherein the sensing circuit includes a motor sensor configured to detect a rotational speed of the motor output shaft, an exciter sensor configured to detect a rotational speed of the exciter shaft, and an electronic control unit configured to receive output from the motor sensor and the exciter sensor and configured to determine, based on the output, if the tension in the belt is less than the minimum tension value.

4. The compactor of claim 2, wherein the sensing circuit includes a motor sensor configured to detect a rotational speed of the motor output shaft, a current sensor configured to detect an electrical current drawn by the motor, and an electronic control unit configured to receive output from the motor sensor and the current sensor and configured to determine, based on the output, if the tension in the belt is less than the minimum tension value.

5. The compactor of claim 2, wherein the sensing circuit is configured to directly measure a characteristic of the belt to detect if the belt tension is below the minimum tension value.

6. The compactor of claim 5, wherein the sensing circuit is configured to measure vibration of the belt.

7. The compactor of claim 6, wherein the sensing circuit includes a non-contact sensor configured to measure vibration of the belt.

8. An outdoor power equipment comprising:

a drive assembly including a drive shaft;

a working assembly including a driven shaft separate and distinct from the drive shaft;

a belt operatively coupled to the drive assembly and to the working assembly, the belt configured to transfer torque from the drive shaft to the driven shaft; and a sensing circuit configured to detect if an amount of tension in the belt is below a minimum tension value, wherein the sensing circuit indirectly determines the amount of tension in the belt.

9. The outdoor power equipment of claim 8, wherein the sensing circuit includes a load cell configured to detect a load applied by the belt onto the drive assembly.

10. The outdoor power equipment of claim 8, wherein the sensing circuit includes a load cell configured to detect a load applied by the belt onto the working assembly.

11. The outdoor power equipment of claim 10, wherein the load cell is a first load cell, and wherein the sensing circuit further includes a second load cell configured to detect a load applied by the belt onto the drive assembly.

12. The outdoor power equipment of claim 11, wherein the sensing circuit includes an electronic control unit configured to receive output from the first and second load cells and, from the output, determines the amount of tension in the belt.

13. The outdoor power equipment of claim 8, further comprising an indicator configured to alert an operator of the outdoor power equipment if the tension within the belt is below the minimum tension value.

14. An outdoor power equipment comprising:

a drive assembly including a drive shaft;

a working assembly including a driven shaft separate and distinct from the drive shaft;

a belt operatively coupled to the drive assembly and to the working assembly, the belt configured to transfer torque from the drive shaft to the driven shaft; and a sensing circuit configured to detect an amount of tension in the belt and to provide an indication to an operator of the outdoor power equipment if the amount of tension in the belt is below a minimum tension value.

15. The outdoor power equipment of claim 14, wherein the sensing circuit includes a non-contact sensor configured to detect a characteristic of the belt that correlates to the amount of tension within the belt.

16. The outdoor power equipment of claim 15, wherein the sensor is a laser sensor.

17. The outdoor power equipment of claim 15, wherein the sensor is an ultrasonic sensor.

18. The outdoor power equipment of claim 15, wherein the non-contact sensor is configured to detect vibration of the belt.

19. The outdoor power equipment of claim 18, wherein the sensing circuit includes an electronic control unit operatively coupled to the non-contact sensor, and wherein the electronic control unit is configured to correlate the vibration of the belt with the amount of tension within the belt.

20. The outdoor power equipment of claim 14, wherein the outdoor power equipment is a plate compactor.

* * * * *